United States Patent [19]

Sitter

[11] Patent Number: 4,520,774

[45] Date of Patent: Jun. 4, 1985

[54] FUEL INJECTION APPARATUS WITH PILOT INJECTION AND MAIN INJECTION IN INTERNAL COMBUSTION ENGINES

[75] Inventor: Erhard Sitter, Horb, Fed. Rep. of Germany

[73] Assignee: Robert Bosch GmbH, Stuttgart, Fed. Rep. of Germany

[21] Appl. No.: 644,071

[22] Filed: Aug. 24, 1984

[30] Foreign Application Priority Data

Aug. 26, 1983 [DE] Fed. Rep. of Germany ..... 3330774

[51] Int. Cl.[3] ..... F02M 45/02; F02M 59/38

[52] U.S. Cl. ..... 123/300; 123/575; 239/533.5; 417/494

[58] Field of Search ..... 123/299, 300, 575, 576, 123/577, 179 L; 239/88–95, 533.1–533.12; 417/493, 494, 498

[56] References Cited

U.S. PATENT DOCUMENTS

| | | | |
|---|---|---|---|
| 2,173,813 | 9/1939 | Bischof | 123/300 |
| 3,394,891 | 7/1968 | Voit | 239/533.5 |
| 3,403,861 | 10/1968 | Eidtmann et al. | 239/533.5 |
| 3,752,137 | 8/1973 | Kimberley | 123/299 |
| 4,022,165 | 5/1977 | Eckert | 123/300 |
| 4,289,098 | 9/1981 | Norberg et al. | 123/299 |
| 4,356,976 | 11/1982 | Eblen | 239/533.5 |
| 4,389,987 | 6/1983 | Frankle | 123/300 |
| 4,426,198 | 1/1984 | Bastenhof | 123/299 |

FOREIGN PATENT DOCUMENTS

| | | | |
|---|---|---|---|
| 1284687 | 12/1968 | Fed. Rep. of Germany | 123/300 |

*Primary Examiner*—Carl Stuart Miller

*Attorney, Agent, or Firm*—Edwin E. Greigg

[57] ABSTRACT

A fuel injection apparatus with pilot injection and main injection in Diesel engines is proposed. A high-pressure injection pump delivers a main injection quantity to a main injection nozzle, while a hydraulic pilot injection auxiliary pump driven by the supply pressure of the high-pressure injection pump positively displaces a pilot injection quantity, via a piston, and delivers it to a pilot injection nozzle which is either separate or combined with the main injection nozzle. In the main injection area, a storage piston is separately provided, which without being mechanically connected to the pilot injection piston and without a pressure division is initially acted upon solely by the supply pressure of the high-pressure injection pump and only in the course of the pilot injection piston stroke is a line leading on to the storage piston opened up, at least indirectly, for the pumped fuel.

15 Claims, 4 Drawing Figures

FUEL INJECTION APPARATUS WITH PILOT INJECTION AND MAIN INJECTION IN INTERNAL COMBUSTION ENGINES

BACKGROUND OF THE INVENTION

The present invention is based on a fuel injection apparatus as generally defined hereinafter. A known fuel injection apparatus of this kind (German Offenlegungsschrift 30 11 376) is intended exclusively for an application in which separate injection nozzles in a Diesel engine for main fuel and an igniting fuel are supplied with a main fuel which does not readily ignite and is pumped by a high-pressure injection pump, on the one hand, and an igniting fuel which is pumped by a separate pump via a hydraulic auxiliary pump, on the other. In this known apparatus, a pilot injection piston in the auxiliary pump is driven at the supply pressure of the high-pressure injection pump by a piston of larger diameter and positively displaces a pilot injection quantity from a work chamber disposed before it to the separate nozzle for the pilot injection. In order to be able to adjust the stroke path of the pilot injection piston positively displacing the pilot injection quantity, and hence to be able to adjust the pilot injection quantity itself, during engine operation, the pilot injection piston has adjusting means which limit its stroke. In this known apparatus, however, the timing of the pilot injection and the main injection with respect to one another is structurally invariable because of a stop in the preceding work chamber, which is effective in the supply direction and fixes the end of the pilot injection piston stroke, and also because of the displacement volume of the larger piston. It would therefore be problematic or even impossible to attain a correct phase relationship between the pilot and the main injection with an injection apparatus of this kind, for the further reason that dependencies on the rpm and load resulting from the dynamic influence of the lines and throttle conduits cannot be precluded. Furthermore, it is impossible to vary the instant of injection for the pilot injection in an intended manner and in terms of its timing with respect to the main injection while at the same time retaining the means of determining the pilot injection quantity.

It is well known that undesirable operating noise in Diesel engines can be attributed to the very rapid liberation of energy at the onset of combustion, and so attempts have long been made to initiate combustion by means of a pilot injection quantity which is limitable and also positionable at the desirable time with respect to the main injection, and thereby to limit the speed of combustion. The solution which presents itself in this connection, that is, the disposition of two complete, separate injection systems functioning in parallel, is complicated and not recommended, because not only are two pumps, two lines and two nozzles required, but also the means necessary for synchronizing the two systems.

It is also known to attain pilot injection effects by the suitable dimensioning of a standard injection system; in this case, a predetermined relationship in terms of size and function must be maintained for the pilot stroke, line diameters, nozzle ports and nozzle springs. This provision, however, leads to a disadvantageous dependency on load and rpm and on the varying dynamic influences during engine operation.

It is also known to provide additional control devices and an intermediate reservoir in injection pumps, by which it is possible to reduce the supply speed by throttling down to the vicinity of zero. Since an initial step or gradation can build up in this case in the pressure wave traveling in the nozzle, it is possible, at certain rpm and load levels, to attain a sort of pilot injection.

Even if the pilot injection is performed in terms of its metering and timing position by two systems having two injection pumps the camshafts of which are coupled together, difficulties arise in attaining the correct phase relationship between the pilot and the main injection, because of the dependency on rpm and load resulting from the dynamic influence of the two lines.

To attain a pilot injection and main injection, another apparatus is also known (German Patent 1 252 001), in which a separate, small piston for the pilot injection is disposed axially parallel to but offset from a loading piston for the main injection inside a fuel injection valve. A separate supply of low pressure can thereby be dispensed with, and the pilot injection quantity is derived from the fuel supply for the main injection quantity—but this does not preclude a disadvantageous effect on the standing pressure in the pressure line and hence inaccuracy in terms of the quantity control.

Finally, for controlling the pilot injection quantity in internal combustion engines, it is also known (German Offenlegungsschrift 28 34 633) to provide a one-piece control slide which is displaceable counter to the force of a spring and which furnishes the various connections desired for pilot and main injection with a pronounced intermediate relief into a reservoir via control edges. Here, again, the pilot injection is diverted from the supply quantity of the injection pump that also provides the main injection quantity, so that the accuracy of quantity control for the main injection quantity is impaired.

OBJECT AND SUMMARY OF THE INVENTION

The fuel injection apparatus according to the invention has the advantage over the prior art that the main injection occurs at an interval after the pilot injection which can be predetermined precisely and is arbitrarily adjustable. Since the supply pressure built up by the high-pressure injection pump at first serves the sole purpose of the pilot injection and acts only upon the compression side of the pilot injection piston, instead of a division of pressure being effected from the beginning as is usually the case, it is possible by means of the invention to specify in advance both the instant of pilot injection onset and the pilot injection quantity—the latter in the conventional manner by specifying the pilot injection piston stroke—and then to specify the exact injection interval between the pilot injection and the main injection, and furthermore to specify in advance the main injection quantity in terms of the total fuel quantity pumped, and to rank all of these provisions within a predeterminable time frame.

Since according to one important characteristic of the present invention the inflow of fuel pumped by the high-pressure injection pump to the components responsible for the main injection does not take place at all until the pilot injection piston has executed a predetermined stroke, typically when the pilot injection has ended, a high injection speed and a correspondingly high pressure are attained for the main injection. The necessity of providing a pressure step or gradation during the pilot injection, in order to prevent the main injection from taking place, is entirely eliminated.

It is also advantageous that the two pistons provided for realizing the present invention, namely the pilot injection piston and the reservoir piston which by its setting specifications determines the injection interval, are actuated chronologically by the supply pressure of the high-speed injection pump.

Finally, a particular advantage is also attained because with exclusively pilot-injection operation, that is, when the fuel for the pilot injection and for the main injection is drawn from the same source (in contrast to two-fuel operation), the filling of the pilot injection element can be accomplished from the volume of fuel stored in reserve in the main injection system of the apparatus.

A particularly advantageous feature of the invention is the axially parallel offset of the pilot injection piston relative to the reservoir piston for the main injection and the opportunity thereby provided, by disposing a simple pressure conduit in the common housing which is opened up by the movement of the pilot injection piston itself, to delivery the fuel pumped by the high-pressure injection pump to the main injection system after the end of the pilot injection. Thus the pressure is not divided but is instead carried along farther, and both systems (for the pilot injection and the main injection) are always exposed to the full pressure, so that the longer connecting lines and pressure lines otherwise found in conventional pressure division, as well as their dynamic behavior, which is also dependent on load and rpm, need no longer be taken in consideration.

The invention will be better understood and further objects and advantages thereof will become more apparent from the ensuing detailed description of preferred embodiments taken in conjunction with the drawings.

DESCRIPTION OF THE PREFERRED EMBODIMENTS

The fundamental concept of the present invention is to use separate pistons, moved by the supply pressure of a high-pressure injection pump, for the areas of pilot injection and main injection, the pistons being in the form of a pilot injection piston and a main injection storage or reservoir piston. The pilot injection piston, by its movement, at least indirectly controls the later delivery of the fuel, pumped at high pressure by the high-pressure injection pump, to the area of the main injection, so that as a consequence the entire supply pressure of the high-pressure injection pump is initially used for the sake of the pilot injection piston and its stroke movement.

Figure 1:
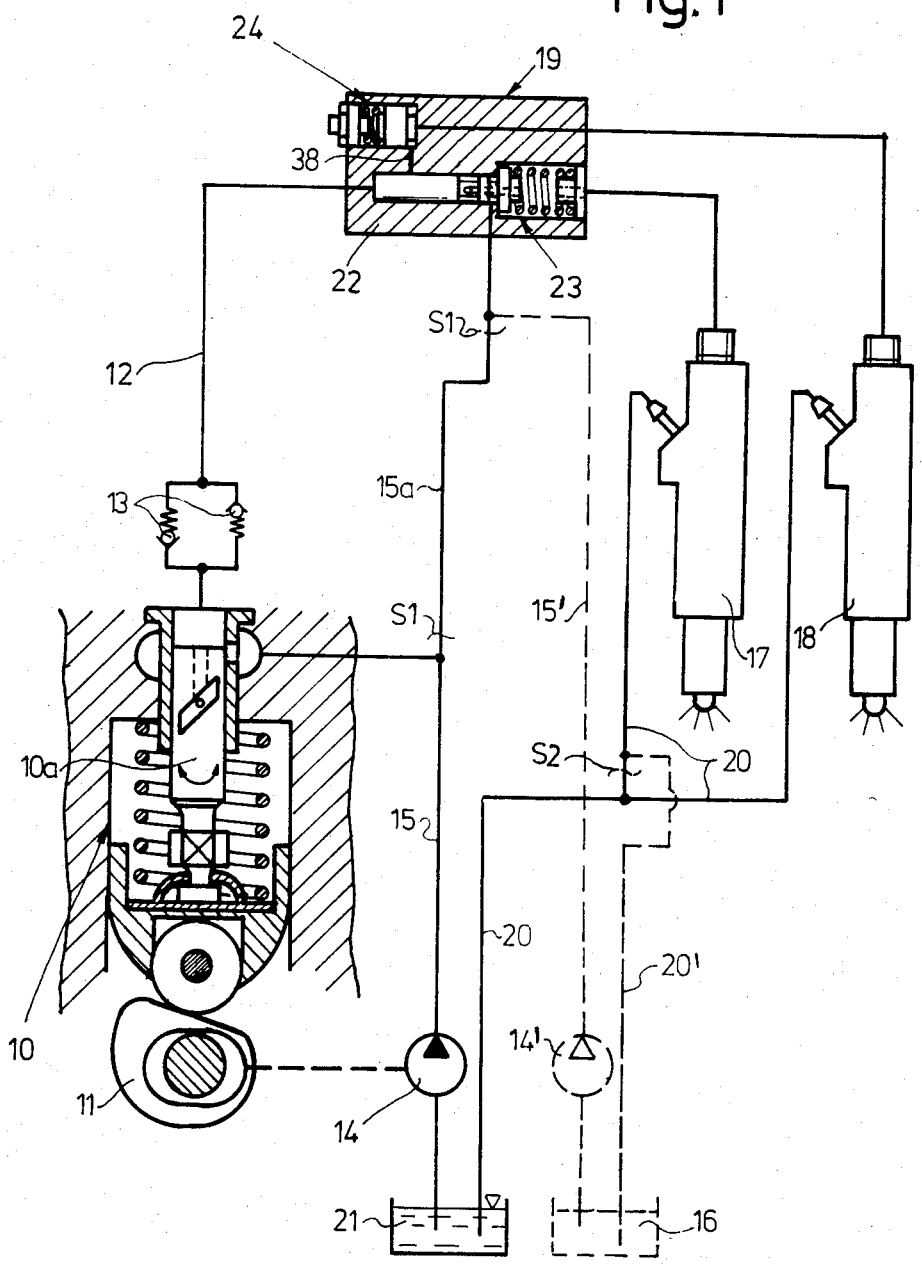
FIG. 1, in highly schematic form, shows a first form of embodiment of the invention which is suitable for use in two-fuel operation.

The high-pressure injection pump is generally shown at 10 in FIG. 1; it is controlled in its course of operation by a camshaft 11 and is otherwise embodied in a known manner and therefore need not be described in detail here. The volume of fuel pumped by the high-pressure injection pump 10 upon each stroke of the pump piston 10*a* via a pressure line 12, in which two check valves 13 disposed in parallel but opening in opposite directions are included for the purpose of balanced pressure relief, is supplied to the high-pressure pump 10 by a low-pressure feed pump 15 via a feed line 15. Via a continuing connecting line 15*a*, the same fuel that has been pumped by the low-pressure feed pump 14 reaches the area of the pilot injection as well. This connecting line 15*a* is dispensed with, however, if the present invention is used with two-fuel operation, in which case the internal combustion engine is supplied with igniting fuel at first, for instance via a pilot injection nozzle, and then is supplied with fuel that is not readily ignited in the course of the main injection, via a main injection nozzle, and is then replaced by a separate pressure line 15', which is shown in dashed lines in FIG. 1 and by way of which igniting fuel is delivered from a separate tank 16 by a second low-pressure feed pump 14' provided in that case.

FIG. 1 shows the pilot injection nozzle 17, the main injection nozzle 18 and the hydraulic auxiliary pump 19 driven by the supply pressure of the high-pressure injection pump, as well as return lines 20 leading back to a tank 21, from which the first low-pressure feed pump 14 draws its fuel. When the apparatus is used for two-fuel operation, a return line 20' is naturally provided for the pilot injection nozzle as well, leading back into the other tank 16 and being separate from the return line 20 for the pilot injection nozzle 17. In that case the portion of the connecting line 15*a* located between two intersections S1 is omitted, and the return line 20 connected to the injection nozzle 17 is divided at the intersection S2.

In the housing 22 of the hydraulic pilot injection auxiliary pump 19, two systems are disposed in a three-dimensional relationship, preferably axially parallel and offset beside one another, and in terms of the course of their functions they follow one another chronologically. These are a first system 23, which is responsible for the pilot injection, and a second system 24, which is responsible for the main injection. As shown in greater detail in FIG. 2, the pilot injection system 23 includes a piston 25 for pilot injection, which is supported in a sliding, displaceable manner in a stepped bore 26 of the housing 22. The compression end of the piston 25 is closed off by a pressure connection 27, which communicates with the pressure line 12 from the high-pressure feed pump 10. The piston 25 extends with a spring seat 28 into an enlarged work chamber 29, in which a biasing spring 30, embodied as a compression spring, is also disposed, pressing the piston against its stop seen on the left-hand side of the drawing in FIG. 2. The piston 25 may have an extension 31 beyond the spring seat 28, containing a throttle restriction 32 which is part of a longitudinal piston bore 33, which connects the work chamber 29 with a transverse bore 35 discharging into an annular groove 34 on the piston. The inlet connection for the low-pressure feed pump intake is shown at 36. The pilot injection quantity positively displaced from the work chamber 29 of the pilot injection piston 25 flows to the pilot injection nozzle 17 (FIG. 1) via a pressure connection 37.

Figure 2:
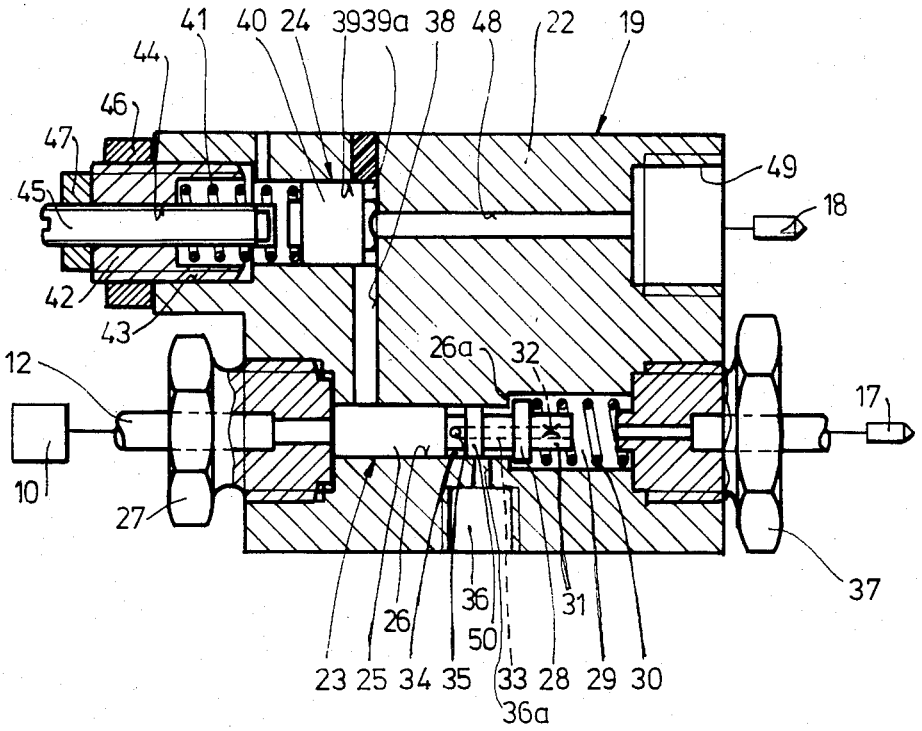
FIG. 2, corresponding to FIG. 1 and in cross section, shows the hydraulically driven pilot injection auxiliary pump, which also includes elements which are part of the main injection.

In the starting position of the pilot injection piston 25 shown in FIG. 2 (that is, the stop is at the left, effected for instance by the contact of the spring seat 28 with a shoulder 26*a* formed by the stepped bore 26, or by the contact of one pressure face of the piston with the screwed-in pressure connection 27), the pilot injection piston 25 itself therefore covers and blocks off an internal pressure conduit 38 leading on toward the main injection system 24 so as to provide a later pressure division; this conduit 38 is embodied by a transverse bore or transverse conduit, by way of example.

The main injection system 24 includes a storage or reservoir piston 40 supported in a slidably displaceable manner in a bore 39; this piston 40 is pressed into its starting position, on the right as seen in the drawing, by a compression spring 41, which rests on the posterior face of the piston and is supported in the bore bottom, extending from there, of a threaded sheath 42, which is in turn screwed into a portion 43 of the bore 39 having an enlarged diameter and an internal thread. An adjusting screw 45 extends through an internal bore 44, which is threaded, in the sheath 42, so that by tightening the adjusting screw 45 to a greater or lesser extent it is possible to adjust the distance between its inner end and the piston end, and thus the stroke executed by the storage piston 40 when it is acted upon by the supply pressure of the high-pressure injection pump. The threaded sheath 42 and the adjusting screw 45 are fixed in position with the aid of lock nuts 46 and 47.

A further pressure line 48 connects the work chamber 39*a* of the storage piston 40, which chamber is defined by the bottom of the bore 39, with the pressure connection for the main injection (not shown in the drawing), which is screwed into the connection thread shown at 49.

Based on the above-described mechanical structure, the function of the apparatus is as follows:

The quantity of fuel pumped by the high-pressure injection pump 10 initially presses the pilot injection piston 25—and exclusively this piston 25, because it can act only upon this element—toward the right in the drawing, counter to the spring force of its biasing spring 30, and effects the positive displacement of a prespecifiable, structurally determinable pilot injection quantity from the work chamber 29 to the pilot injection nozzle 17. The pilot injection begins at the instant when a rib 50 adjoining the annular groove 34 on the pilot injection piston 25 covers an inflow bore 36*a* from the low-pressure feed pump 14, and as the stroke of the pilot injection piston 25 continues the pilot injection lasts until such time as the rib 50 has again uncovered the bore, thereby relieving the work chamber 39*a* via the annular groove 34. Because of this uncovering effected by the pilot injection piston 25 itself, a specific pilot injection quantity $Q_{VE}$ results. During the stroke of the pilot injection piston 25, preferably after the uncovering or after the end of the pilot injection, the pressure conduit 38, as the connecting bore between the two systems 23 and 24, is uncovered by the driven pilot injection piston 25. The storage piston 40 now takes on the function of storing a portion of the fuel quantity pumped by the high-pressure feed pump 10; it does so by executing its stroke, counter to the spring pressure acting upon it, until it runs up against the stop formed by the adjusting screw 45. Only then does the pressure to the main injection nozzle 18 increase, and the main injection begins. The running up of the storage piston 40 against the stop and the fuel quantity thereby received thus assures the required injection interval (for instance, 7° to 8° of crankshaft angle), during which period the high-pressure injection pump 10 continues to pump, acting as the main injection pump. After the main injection has ended (opening up of the high-pressure injection pump), the total fuel quantity stored is then either forced back into the main injection pump 10 by the restoring springs 41 and 30 of the two systems, or else it can be used as a filling quantity for the pilot injection, as will be explained below with reference to FIGS. 3 and 4. Since initially the full pressure of the fuel pumped by the high-pressure injection pump acts exclusively upon the pilot injection piston 25, a pressure step-up in the pilot injection system can be dispensed with; nevertheless, a large displacement volume is assured by the disposition according to the invention, and this volume can be varied arbitrarily by the position of the adjusting screw 45, so as to attain a variable injection interval. The throttle 32 in the longitudinal conduit 33 of the pilot injection piston 25 is suitably selected not to be overly narrow, so as to assure the immediate relieving of the work chamber 29 during the overflow stroke.

Since the exemplary embodiment shown in Figs. 3 and 4 makes use of identical important components and functional characteristics of the first exemplary embodiment, these identical elements are identified with the same reference numerals, and only the differences from their counterparts in the first embodiment will be described in detail below. Elements which differ slightly are identified by the same reference numeral, provided with double primes.

Figure 3:
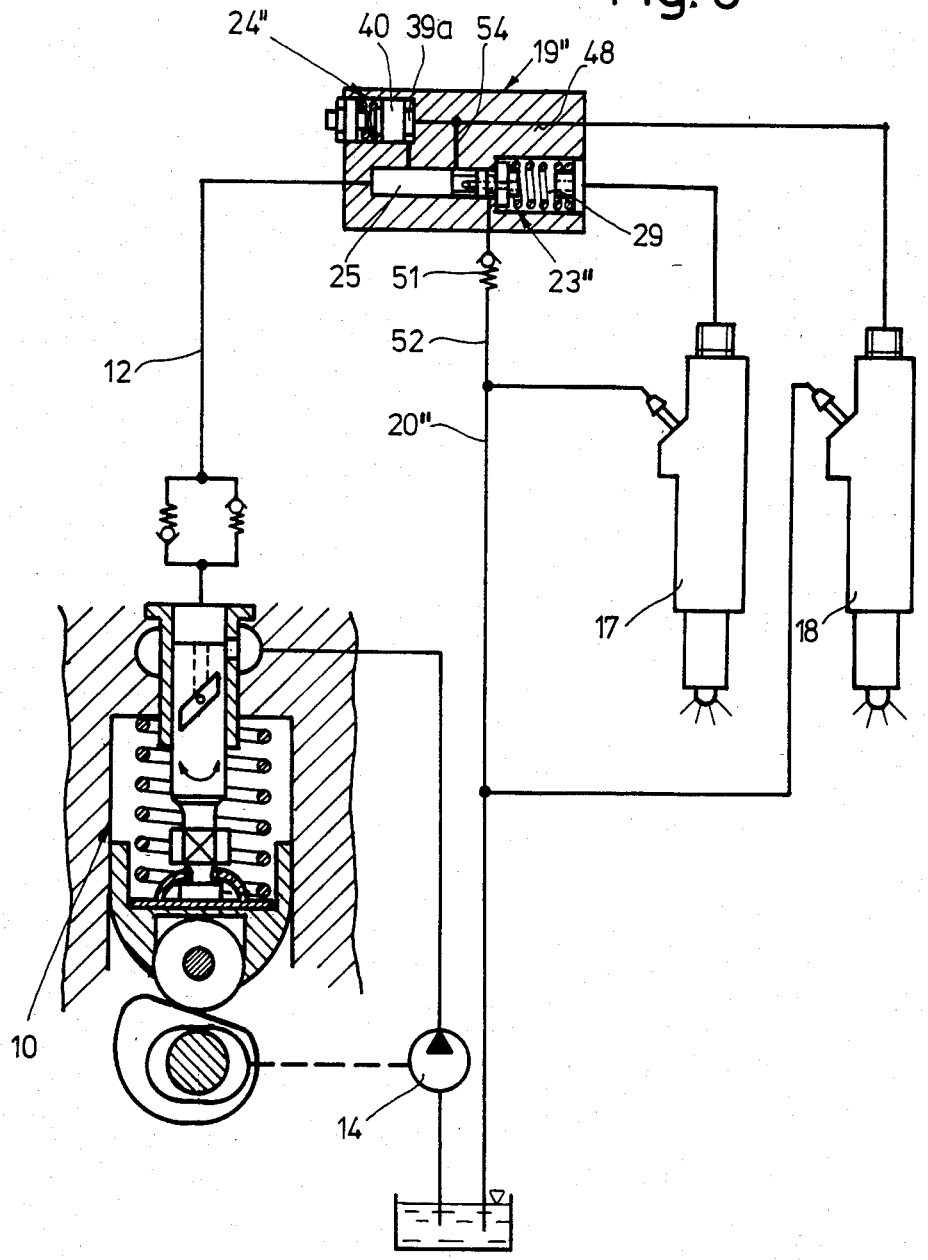
FIG. 3 is a second schematic illustration of a fuel injection apparatus which is not suitable for two-fuel operation but otherwise corresponds to a great extent with the form of embodiment shown in FIG. 1, and in which the volume of fuel stored in the area of the main injection can be used for filling the pilot injection element.
Figure 4:
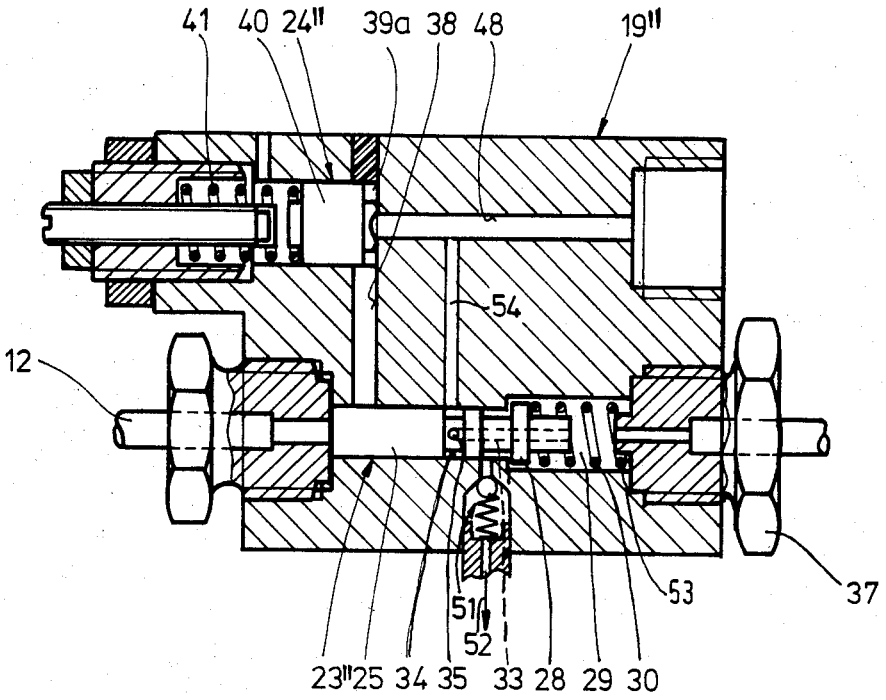
FIG. 4 is a cross-sectional view of the hydraulic pilot injection auxiliary pump of FIG. 3.

The form of embodiment shown in FIGS. 3 and 4 is not suitable for use in two-fuel operation. Only a single pressure line 12 is provided, which leads from the high-pressure feed pump 10 to the hydraulic auxiliary pump 19″. A separate low-pressure supply line from the low-pressure feed pump 14, which here only supplies the high-pressure injection pump, to the auxiliary pump 19″ can be dispensed with. The only provision required in this respect is a leak-off return line 52, sealed off via a check valve 51, leading from the pilot injection system 23″ approximately as far as the leak-off fitting at the return line 20″ of the pilot injection nozzle 17, because the stored fuel quantity which the storage piston 40 of the main injection system 24″ positively displaces out of its work chamber 39*a* after the supply stroke of the high-pressure injection pump 10 is used as the fill quantity for the pilot injection. To this end, an additional transverse connection 54 back from the high-pressure injection system 24″ to the pilot injection system 23″ is provided, which connects a branch of the pressure outlet conduit 48 of the main injection system 24″ with a suitable discharge location in the piston guide for the pilot injection piston 25, so that in the starting position, prior to the supply stroke of the high-pressure injection pump 10, the pilot injection system 23″ can receive the appropriate fuel quantity and deliver it to its work chamber 29.

In the detailed illustration of FIG. 4, this connecting conduit 54 is illustrated such that in the starting position of the pilot injection piston 25 it discharges in the vicinity of the annular groove 34. Axially offset toward the work chamber 29, the leak-off return line 52 provided with the check valve 51 is connected to the piston guide for the pilot injection piston 25. The volume of fuel positively displaced by the storage piston 40 of the main injection system 24" therefore travels via the transverse and longitudinal bores 35 and 33 in the piston 25 to the work chamber 29. The uncovering or opening in order to determine the pilot injection quantity can be performed either by connecting the leak-off return line 52 via the annular groove 34 with the transverse bore 35 to the longitudinal piston conduit 33 and work chamber 29, or else by the running up of the pilot injection piston 25 against a stop 53 after it has opened up the first connecting conduit 38. The remaining elements of the auxiliary pump shown in FIG. 4 correspond in their function and effect to those shown in FIG. 2, so that they need not be identified by reference numerals or described once again.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection apparatus with pilot injection and main injection in internal combustion engines, in particular Diesel engines, having a main injection nozzle supplied with a main injection quantity by a high-pressure injection pump and a hydraulic pilot-injection auxiliary pump driven by the supply pressure of the high-pressure injection pump, said auxiliary pump arranged to contain a pilot injection piston and a work chamber disposed in proximity thereto and from which the pilot injection quantity is positively displaced to a pilot injection nozzle, means for adjusting the useful stroke of the pilot injection piston and for prespecifying the pilot injection quantity ($Q_{VE}$), the combination comprising, a storage piston provided independently of said pilot injection piston and mechanically separate therefrom for the determination of said prespecifiable injection interval between said pilot injection and said main injection, said pilot injection piston being disposed such that while avoiding an initial pressure division, the supply pressure generated by said high-pressure injection pump acts solely upon the pilot injection piston and subsequently, as a result of the stroke movement of said piston, uncovers a pressure conduit which leads to the storage piston.

2. A fuel injection apparatus as defined by claim 1, further wherein a low-pressure feed pump delivers fuel to the high-pressure injection pump and said work chamber of said pilot injection piston.

3. A fuel injection apparatus as defined by claim 1, further wherein a further low-pressure pump delivers an igniting fuel to said work chamber of said pilot injection piston.

4. A fuel injection apparatus as defined by claim 1, further wherein said pilot injection piston and said storage piston, are disposed in a housing offset from one another in an axially parallel manner.

5. A fuel injection apparatus as defined by claim 4, further wherein said pressure conduit leads to a work chamber confronting said storage piston, said conduit when in a starting position of said pilot injection piston being initially covered by said piston and hence blocked off, and said conduit further being uncovered once said storage piston has executed its working stroke for positively displacing said pilot injection quantity.

6. A fuel injection apparatus as defined by claim 1, further wherein said pilot injection piston is provided, with an annular groove for determining the pilot injection quantity, said groove arranged after a prespecified stroke, to relieve the work chamber by opening it up into a low-pressure feed pump intake.

7. A fuel injection apparatus as defined by claim 1, further wherein said pilot injection piston is provided, with an annular groove for determining the pilot injection quantity, said groove arranged after a prespecified stroke, to relieve the work chamber by opening it up into a leak-off connection.

8. A fuel injection apparatus as defined by claim 1, further wherein said storage piston has a stroke, and means are provided for adjusting said stroke of said storage piston for a desired injection interval between said pilot injection and said main injection.

9. A fuel injection apparatus as defined by claim 4, further wherein said storage piston has a stroke, and means are provided for adjusting said stroke of said storage piston for a desired injection interval between said pilot injection and said main injection.

10. A fuel injection apparatus as defined by claim 6, is further wherein said storage psiton has a stroke, and means are provided for adjusting said stroke of said storage piston for a desired injection interval between said pilot injection and said main injection.

11. A fuel injection apparatus as defined by claim 8, further wherein said adjusting means for said injection interval comprises a screw supported in a threaded sheath, the distance between which screw and an end of said storage piston is adjustable.

12. A fuel injection apparatus as defined by claim 9, further wherein said adjusting means for said injection interval comprises a screw supported in a threaded sheath, the distance between which screw and an end of said storage piston is adjustable.

13. A fuel injection apparatus as defined by claim 10, further wherein said adjusting means for said injection interval comprises a screw supported in a threaded sheath, the distance between which screw and an end of said storage piston is adjustable.

14. A fuel injection apparatus as defined by claim 5, further wherein a second transverse conduit is provided, which at least indirectly connects said work chamber of said storage piston with said work chamber of said pilot injection piston so that the fuel quantity stored by the retreating of said storage piston embodies the fill quantity for said pilot injection upon the next piston stroke.

15. A fuel injection apparatus as defined by claim 6, further wherein a second transverse conduit is provided, which at least indirectly connects said work chamber of said storage piston with said work chamber of said pilot injection piston so that the fuel quantity stored by the retreating of said storage piston embodies the fill quantity for said pilot injection upon the next piston stroke.

* * * * *